United States Patent [19]

Leek et al.

[11] Patent Number: 4,656,851

[45] Date of Patent: Apr. 14, 1987

[54] ALARM CAPABILITY FOR PIN TUMBLER LOCKS

[75] Inventors: Bobby J. Leek; Henry L. Self, both of Oxnard, Calif.

[73] Assignee: The United States of America as represented by the Secretary of the Navy, Washington, D.C.

[21] Appl. No.: 856,065

[22] Filed: Apr. 24, 1986

[51] Int. Cl.[4] ..... E05B 47/00

[52] U.S. Cl. ..... 70/277; 70/419; 70/441; 70/DIG. 49

[58] Field of Search ..... 70/277, 278, 419, 421, 70/432, 434, 438, 439, 441, DIG. 49; 350/6.3, 96.1, 96.15, 96.18, 96.19, 286, 600; 361/172

[56] References Cited

U.S. PATENT DOCUMENTS

| | | | |
|---|---|---|---|
| 3,750,158 | 7/1973 | Anastassakis | 70/441 |
| 3,967,481 | 7/1976 | Schlage | 70/419 |
| 4,186,578 | 2/1980 | Sommer | 70/441 |
| 4,573,046 | 2/1986 | Pinnow | 70/277 |

*Primary Examiner*—Robert L. Wolfe

*Attorney, Agent, or Firm*—Louis Allahut; Joseph M. St. Amand

[57] ABSTRACT

Fiber optic sensors are used at one or more of the top pin and spring assemblies in a pin tumbler lock to sense either authorized or unauthorized attempt to open the lock. A fiber optic switching element, in a simple capsule form, can be installed in new or existing locks. Fiber optic circuitry signals surreptitious attempts to open the lock.

8 Claims, 9 Drawing Figures

ALARM CAPABILITY FOR PIN TUMBLER LOCKS

BACKGROUND

This invention relates to alarm mechanisms for locks and particularly to alarm capability for pin tumbler locks.

Intrusion detection systems are used on openings into buildings to notify guards of attempts by unauthorized persons to gain entry. Typically sensors are mounted on the inside of a door and do not sound an alarm until entry is actually accomplished.

Locks used to secure doors can be alarmed by placing a switch on the operating mechanism or the lock bolt. However, that approach has the same result as placing sensors on the inside of a door; an alarm will not be sounded until the lock is turned and opened.

The invention disclosed herein provides alarm capability for the locking system. An alarm will be sounded as soon as the attack begins, even if the key is used by unauthorized personnel, or by otherwise authorized personnel at an unauthorized time.

SUMMARY OF THE INVENTION

The present invention provides alarm capability for pin tumbler lock cylinders. Pin tumbler type lock cylinders are, by their design, inherently vulnerable to surreptitious entry by picking methods and by use of unauthorized duplicate keys. This invention operates to notify an alarm monitor that an entry is being attempted. The basic component of this system is a sensor that can be inserted into the pin cell of a lock cylinder, in place of the driver and drive spring that is normally installed. This type of sensor can be used in any number of pin cells in a lock. The sensor operates to cause an alarm if the bottom pin is moved by a pick, unauthorized key, or an authorized key used at an unauthorized time. The sensor is activated any time a pick or unauthorized key is inserted to move a tumbler pin, or an authorized key is used at an unauthorized time.

BRIEF DESCRIPTION OF THE DRAWINGS

In each of the figures of drawing, like numerals refer to like parts.

DESCRIPTION OF THE PREFERRED EMBODIMENTS

Figure 1:
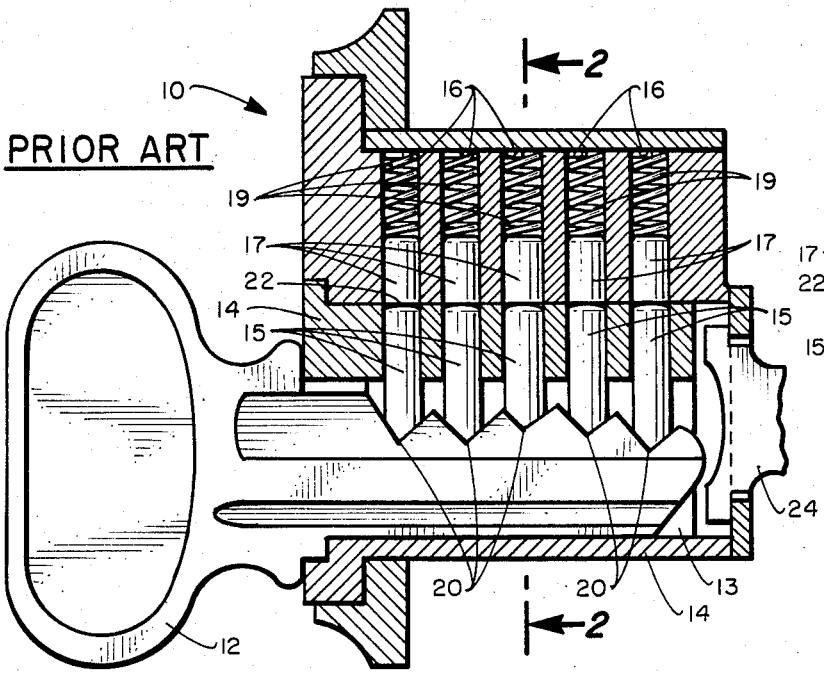
FIG. 1 is a cross-sectional view of a typical prior art lock cylinder.
Figure 2:
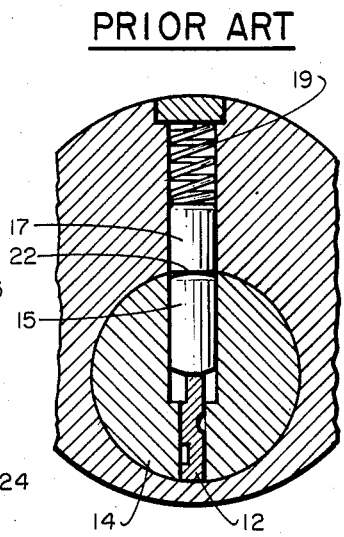
FIG. 2 is a cross-sectional view taken along line 2—2 of FIG. 1.

A typical pin tumbler lock cylinder 10 is shown in FIGS. 1 and 2, by way of example. Normal operation consists of inserting a key 12 into the keyway 13 of a plug 14. The key operates to push the bottom pins or tumblers 15 in pin cells 16 upwards against the top pins or drivers 17 and springs 19. When the key is fully inserted the springs 19 will have pushed against the top pins 17, which in turn push the bottom pins 15 into the cuts 20 in key 12. If the proper key is used, the mating surfaces of the top and bottom pins will be in line with the mating surfaces of the plug 14 and cylinder 10; this is called the shear line. The shear line is shown at 22 in FIGS. 1 and 2. When a shear line is achieved, the plug can be turned by exerting rotational force against the key. A tail piece or cam 24 is attached to the end of the plug to activate a lock bolt or other component, not shown.

Figure 3A:
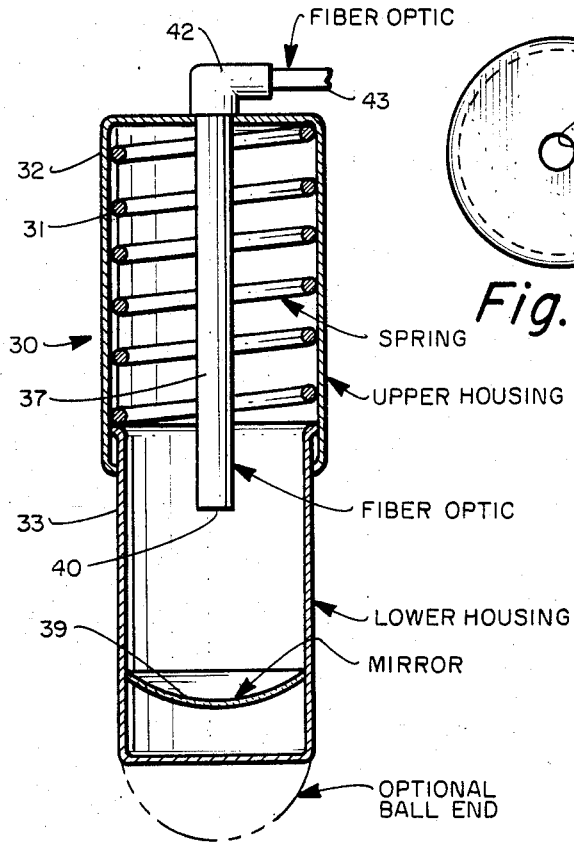
FIG. 3*a* is a vertical cross-sectional view of the fiber optic sensor portion of the present invention.

The fiber optic sensor or switch 30, shown in FIG. 3*a*, replaces one or more of the top pin 17 and spring 19 assemblies in this invention. An internal spring 31 or a compressive/responsive material is used to provide the force necessary for the proper operation of the lock. The fiber optic sensor is intended for two types of installation; the first is for use in existing tumbler locks (FIG. 5), and the second is for use in lock cylinders specifically designed or machined (FIG. 6) for use with the sensor.

Figure 3B:
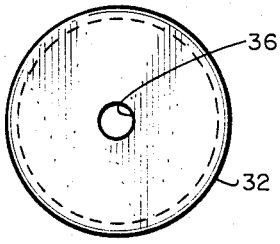
FIG. 3*b* is a top view of the fiber optic sensor shown in FIG. 3*a*.
Figure 5:
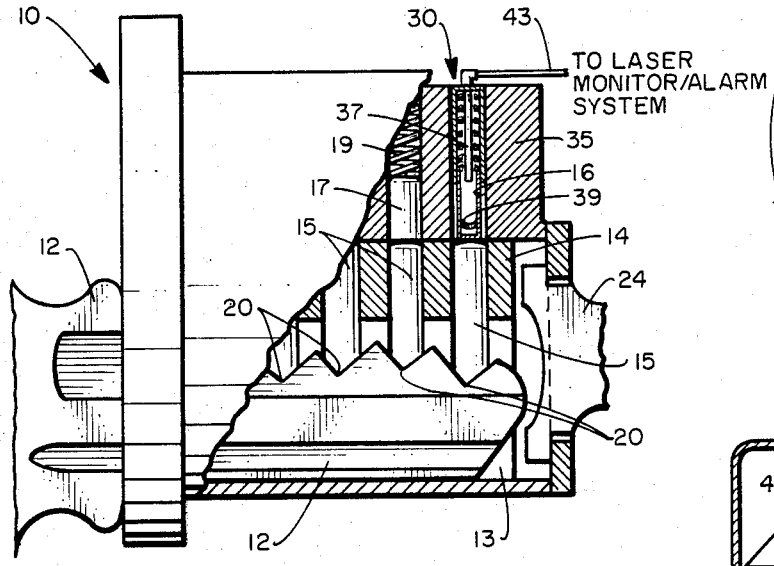
FIG. 5 is a partial cross-sectional view showing a fiber optic sensor or switch, as illustrated in FIG. 3*a*, installed in a pin cell of a lock cylinder, such as in FIGS. 1 and 2.
Figure 6:
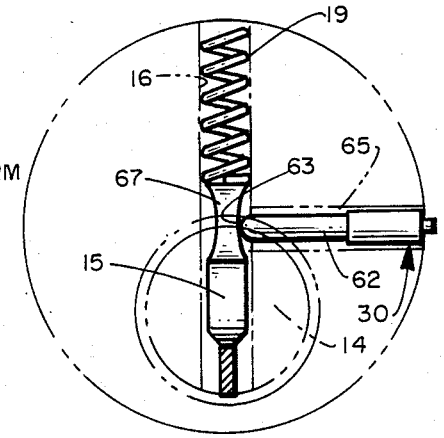
FIG. 6 shows a fiber optic sensor or switch, having a ball end housing as illustrated in FIG. 4, installed in the side of a lock cylinder.

The basic components of the fiber optic sensor, shown in cross-section in FIG. 3*a*, are: an upper housing 32 and a lower housing 33 made from durable material, such as steel, for example, and generally cylindrical in shape, as shown in FIG. 3*b*. The upper housing 32 is pressed or potted or otherwise secured into a pin cell 16 in a cylinder 35, such as shown in FIG. 5, for example. A fiber optic sensor having a ball end lower housing, such as shown in FIG. 4, by way of example, may be used for installation in the side of a modified lock cylinder, as shown in FIG. 6, and hereinafter described.

Figure 4:
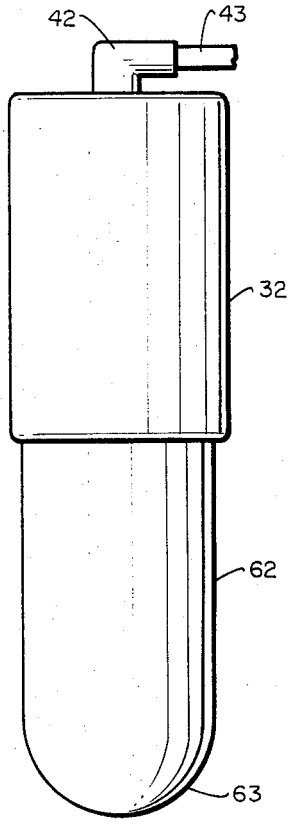
FIG. 4 shows the exterior housing of a sensor similar to the one shown in FIG. 3*a*, but with a ball end lower housing.

The bottom of the lower housing may be squared off, as shown in FIG. 3*a* or rounded as shown in FIG. 4, etc., depending upon the application. The upper housing 32 includes an aperture 36 at the top, as shown in FIG. 3*b*, and holds a fiber optic cable 37 which passes through the aperture. Spring 31, contained in the upper housing 32, provides force against the lower housing 33. The lower housing 33 contains a concave parabolic mirror 39 which receives laser light from and reflects light to end 40 of the fiber optic cable.

Figure 8:
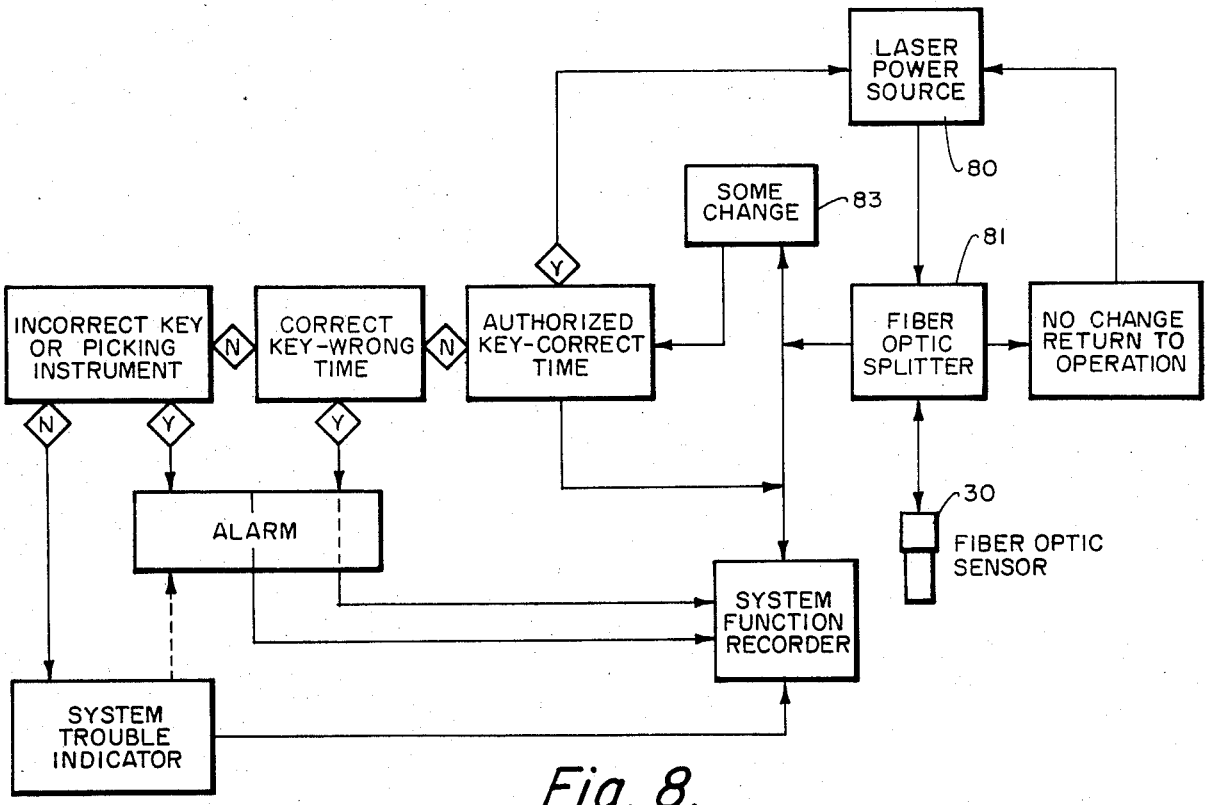
FIG. 8 is a logic diagram of the operation of the present invention.

The fiber optic cable 37 may be connected, as shown in FIGS. 3*a* and 4, via a 90 degree coupler 42 to a fiber optic line 43 which in turn connects to a laser light source in an alarm or monitor system, for example, generally shown in FIG. 8.

Figure 7:
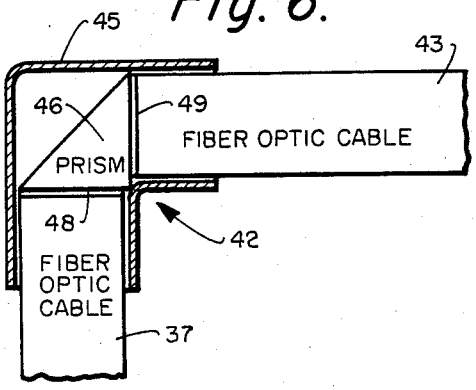
FIG. 7 is a cross-sectional side view of a 90 degree fiber optic connector.

The fiber optics coupler 42, shown in greater detail and in cross-section in FIG. 7, consists of an elbow type housing 45 which contains a prism 46. Fiber optic cable 37 has upper end 48 butted against one side of the prism 46, and the fiber optic cable of line 43 is butted against another side of the prism, at 90 degrees to the first side, as shown.

The fiber optic sensor 30 having a lower housing 62 with a ball end 63, as in FIG. 4, is used as shown in FIG. 6, for example. In this embodiment, a hole 65 is drilled in a horizontal plane perpendicular to the center-line of one of the pin cells 16. A driver pin 67 with concave sides replaces the driver (pin 17 in FIGS. 1, 2 or 5) normally installed in a pin cell. The ball end 63 of housing 62 of the fiber optic sensor seats on the concave surface of pin 67, as shown. Any movement of driver pin 67 will be sensed by the fiber optic sensor 30, which is placed in a perpendicular position to pin 67 in this embodiment and connected as in FIG. 5 to a laser monitor/alarm system.

Fiber optic sensor 30 operates as follows: When sensors 30 are installed in one or more of the cylinder 35 pin cells 34, as shown in FIG. 5, the internal spring 31 will force lower housing 33 downward to an extended position, which forces the bottom pin 15 below the shear line 22, preventing rotation of plug 14. When a key or pick is inserted, the bottom pins 15 push against the bottom of one or more fiber optic sensors. This action compresses each fiber optic sensor 30 such that the distance between the parabolic mirror 39 and end 40 of the fiber optic cable 37 is changed, consequently changing the time for a pulse of laser light from the laser source to reflect off the mirror and return.

The flow diagram of FIG. 8 shows the operation logic of the alarm circuitry. A laser power source 80 sends an impulse of light to the fiber optic sensor 30 through a fiber optic light splitter 81. The laser light impulse is reflected off the parabolic mirror 39 in the lower housing of sensor 30. If there is no change in the impulse time (i.e. there is no compression of the fiber optics sensor 30), the splitter 81 will tell the power source 80 there is no change and to send another pulse.

If there is a change in the reflected laser signal, the splitter will the signal to a "Some Change" circuit 83. Where the change in the laser light impulse is a result of an authorized key being used at an authorized time, the circuit will record the function and return to normal operation. When the change is the result of an authorized key being used at an unauthorized time, the circuit will record the function and go into an alarm mode.

If either an incorrect key or a picking instrument is inserted into the keyway, the system will alarm, and record. And, if a change occurs, but cannot be attributed to one of the above, the system will give a trouble indication which may or may not cause an alarm, but will be recorded.

The fiber optic sensor switches can be made in various diameters and lengths to fit high and low pin cells in security lock cylinders. The housings can be made from either metal or non-metallic capsules; the use of metallic capsules would eliminate the need for a driver pin in many applications. The fiber optic 90 degree coupling can be used where a 90 degree intersection is required, but is not necessary for all applications.

The present system can be retrofitted to existing cylinders or installed in cylinders specifically manufactured for this purpose. The fiber optic sensor switch can be manufactured as a single unit that dropped, threaded or potted into one or more pin cells, and is usable in any of the pin cells of a tumbler lock. The system operates to sound an alarm as soon as an illegal entry is attempted, before the lock can be unlocked.

Obviously many modifications and variations of the present invention are possible in the light of the above teachings. It is therefore to be understood that within the scope of the appended claims, the invention may be practiced otherwise than as specifically described.

What is claimed is:

1. A fiber optic laser sensor system for tumbler locks and the like, comprising;

a. a lock cylinder having a key plug, operable to be rotated by a proper key, and a series of pin tumblers each comprising top and bottom pins and spring means located within pin cells in said lock cylinder and key plug, which are accessible through a longitudinal keyway in said key plug; said pin tumblers normally locking said key plug from rotation within said lock cylinder and being operable to be moved to release position by use of said proper key;

b. fiber optic laser sensor means replacing at least the top pin and spring means in at least one of said series of pin tumblers;

c. each said fiber optic laser sensor means being connected by a first fiber optic light transmitting means to a laser light source in a laser alarm and monitor system;

d. said fiber optic laser sensor means comprising upper and lower sections and including compressive spring means for spacing opposite ends of said upper and lower sections apart a determined distance;

e. a mirror means mounted in the lower section of said fiber optic laser sensor means;

f. a second fiber optic light transmitting means being mounted within the upper section of said fiber optics laser sensor means and in turn being connected to said first fiber optic light transmitting means for transmitting laser light impulses from said laser light source to said mirror means in the lower section and for transmitting reflected laser light from said mirror back to said alarm and monitor system; wherein surreptitious attempts to unlock said lock cylinder with key or pick means will compress said fiber optic laser sensor means, change the distance said laser light impulses travel, and operate to signal said alarm and monitor system of such attempt.

2. A sensor system as in claim 1 wherein all attempts to unlock said lock cylinder, whether by an authorized key, an unauthorized key, a lock pick, or any means which disturbs said fiber optic laser sensor means to change the laser light transmitting distance, are recorded by said laser alarm and monitor system.

3. A sensor system as in claim 1 wherein said mirror means is a parabolic mirror.

4. A sensor system as in claim 1 wherein said fiber optic laser sensor means is encapsulated into upper and lower interfitting cylindrical housing sections forming a unit which is compressible longitudinally.

5. A fiber optic laser sensor system for tumbler locks and the like, comprising;

a. a lock cylinder having a key plug operable to be rotated by a proper key, and a series of pin tumblers, each comprising top and bottom pins and a spring means located within pin cells in said lock cylinder and key plug which are accessible through a longitudinal keyway in said key plug; said pin tumblers normally locking said key plug from rotation within said lock cylinder and being operable to be moved to a release position by use of said proper key;

b. at least one passageway formed in said lock cylinder perpendicular to a said pin cell at the location of a said upper pin therein;

c. the said upper pins, which are located adjacent to a passageway end of said at least one passageway, having concave sides;

d. fiber optic laser sensor means being mounted in said at least one passageway;

e. each said fiber optic laser sensor means being connected by a first fiber optic light transmitting means to a laser light source in a laser alarm and monitor system;

f. said fiber optic laser sensor means comprising forward and aft sections and including compressive spring means for spacing opposite ends of said forward and aft sections apart a determined distance;

g. a mirror means mounted in the forward section of said fiber optic laser sensor means;

h. a second fiber optic light transmitting means being mounted within the aft section of said fiber optics laser sensor means and in turn being connected to said first fiber optic light transmitting means for transmitting laser light impulses from said laser light source to said mirror means in the forward section and for transmitting laser light reflected from said mirror means back to said alarm and monitor system;

i. the end of said forward section being rounded to slideably seat on the concave sides of an upper pin located adjacent to the end of a said at least one passageway;

wherein surreptitious attempts to unlock said lock cylinder with key or pick means will move any said concave upper pin and thus compress said fiber optic laser sensor means, thereby changing the distance said laser light impulses travel, and operate to signal said alarm and monitor system of such attempt.

6. A sensor system as in claim 5 wherein all attempts to unlock said lock cylinder, whether by an authorized key, an unauthorized key, a lock pick, or any means which disturbs said fiber optic laser sensor means to change the laser light transmitting distance, are recorded by said laser alarm and monitor system.

7. A sensor system as in claim 5 wherein said mirror means is a parabolic mirror.

8. A sensor system as in claim 5 wherein said fiber optic laser sensor means is encapsulated into forward and aft interfitting cylindrical housing sections forming a unit which is compressible longitudinally.

* * * * *